United States Patent [19]

Golden

[11] Patent Number: 5,038,427

[45] Date of Patent: Aug. 13, 1991

[54] CONVERTIBLE CRIB - YOUTH BED

[76] Inventor: Robert J. Golden, Rte. 5, P.O. Box 167, Festus, Mo. 63028

[21] Appl. No.: 374,951

[22] Filed: Jul. 3, 1989

[51] Int. Cl.[5] ..... A47D 7/01

[52] U.S. Cl. ..... 5/93.2; 5/208; 5/53.1

[58] Field of Search ..... 5/2 R, 11, 53 R, 93 R, 5/93 B, 201, 207, , 208

[56] References Cited

U.S. PATENT DOCUMENTS

| | | | |
|---|---|---|---|
| 1,378,518 | 5/1921 | Boardman . | |
| 1,388,783 | 8/1921 | Yeager . | |
| 2,223,955 | 12/1940 | Greenbaum | 5/93 R |
| 2,397,697 | 4/1946 | Shaw | 5/11 |
| 2,530,640 | 11/1958 | Wickman | 5/207 |
| 2,677,832 | 5/1954 | Christensen . | |
| 2,754,524 | 7/1956 | Densmore | 5/93 R X |
| 3,365,731 | 1/1968 | Royce | 5/93 R X |
| 3,383,718 | 5/1968 | Spencer | 5/93 R X |
| 3,403,412 | 10/1968 | Gottfried et al. . | |
| 3,727,246 | 4/1973 | Germano . | |
| 3,979,783 | 9/1976 | Spencer | 5/11 X |
| 4,204,286 | 5/1980 | Stiles et al. | 5/11 |
| 4,361,919 | 12/1982 | Hull . | |
| 4,450,597 | 5/1984 | Hull . | |
| 4,525,883 | 7/1985 | Necowitz . | |
| 4,802,298 | 2/1989 | Moroney et al. | 5/93 R X |

*Primary Examiner*—Michael F. Trettel
*Attorney, Agent, or Firm*—Kalish & Gilster

[57] ABSTRACT

A convertible infant's crib comprises a headboard and footboard, each consisting of separable upper and lower units formed of interconnecting slats and panels and having integral legs. The upper endboard units may serve to form the headboard and footboard of a youth bed. The crib has removable sides and a mattress support structure adapted for lowering the mattress height as the infant grows. In order that the same mattress may be used in both the crib and the bed, the crib mattress support structure may also be used in the converted youth bed.

5 Claims, 4 Drawing Sheets

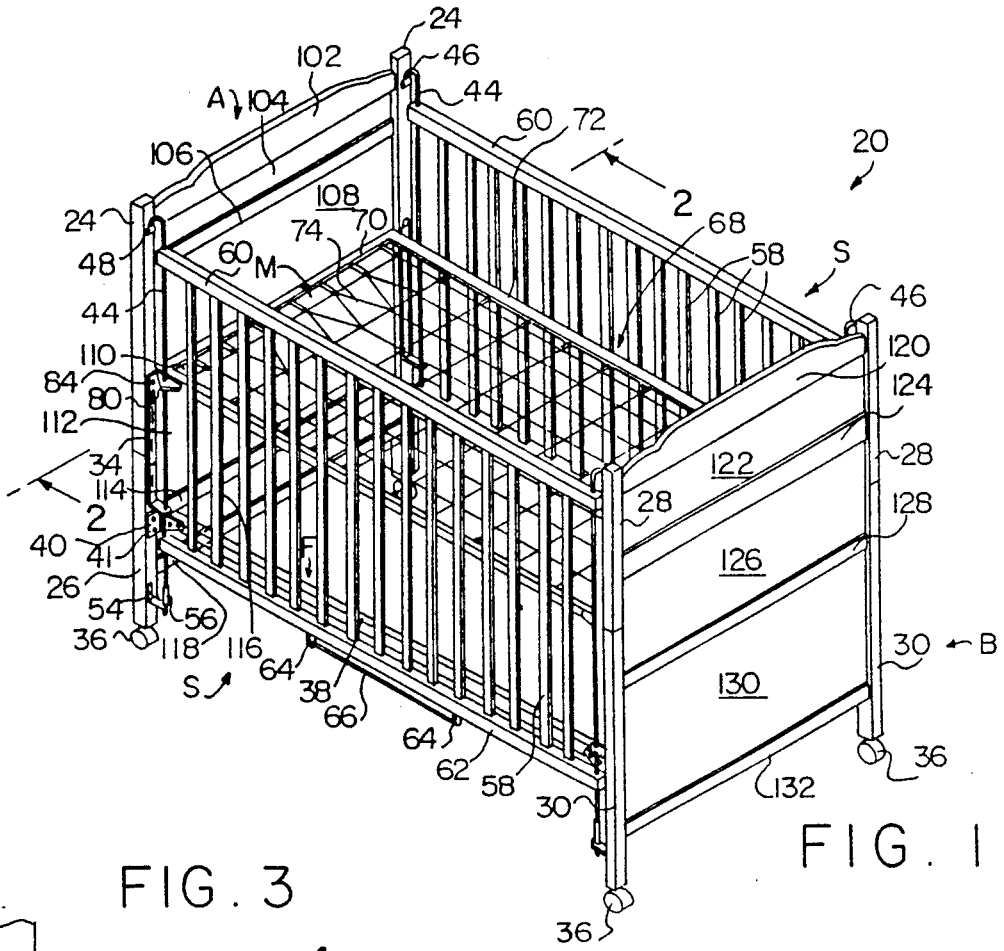
FIG. 1
FIG. 3
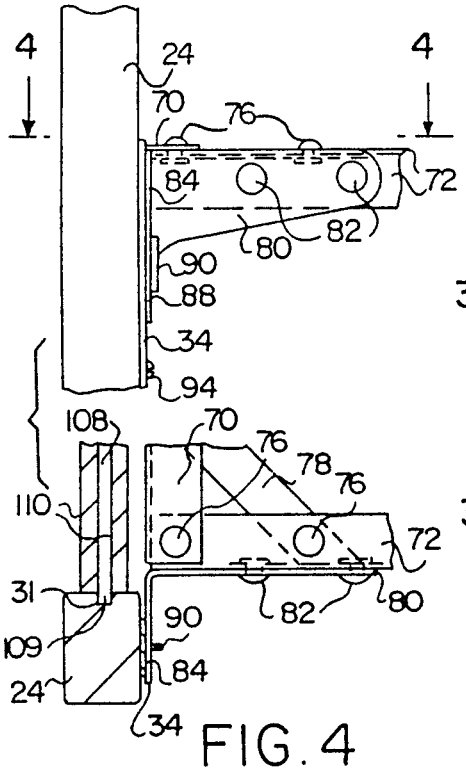
FIG. 4
FIG. 2
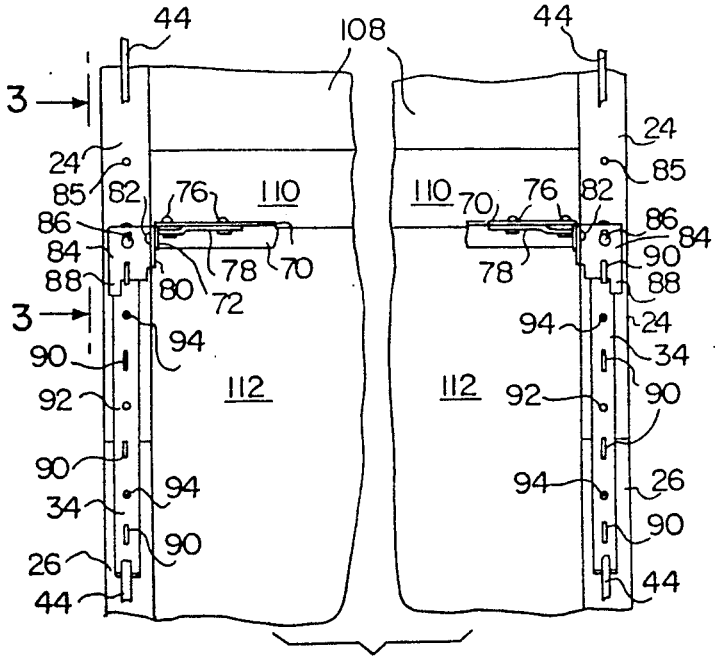

FIG. 5a
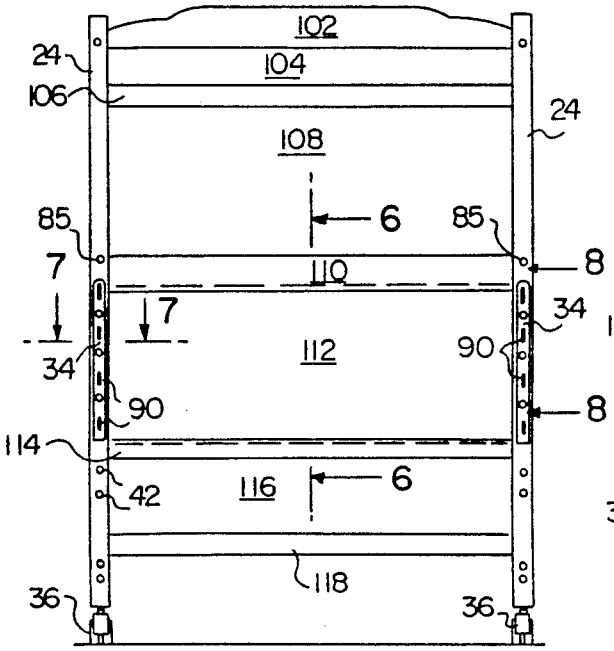
FIG. 5b
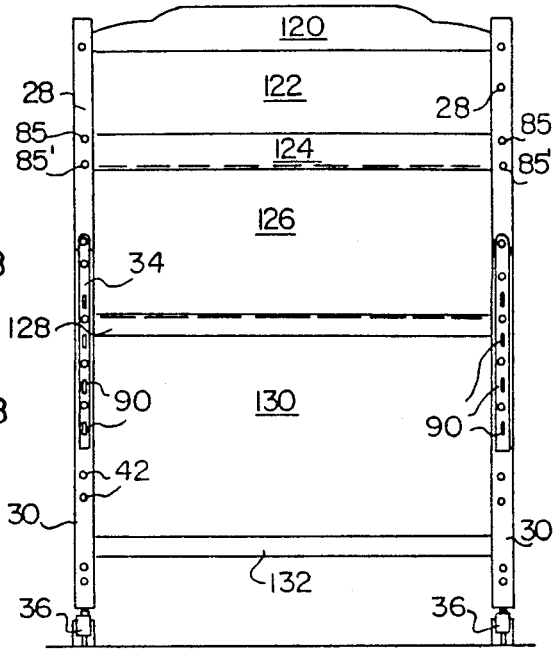
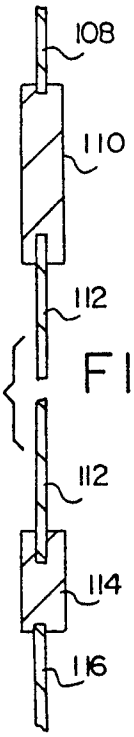
FIG. 6
FIG. 7
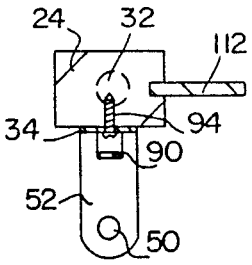
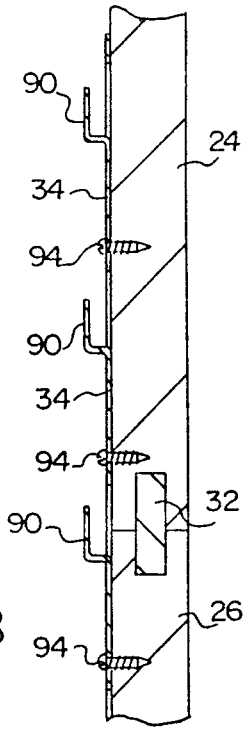
FIG. 8

FIG. 12
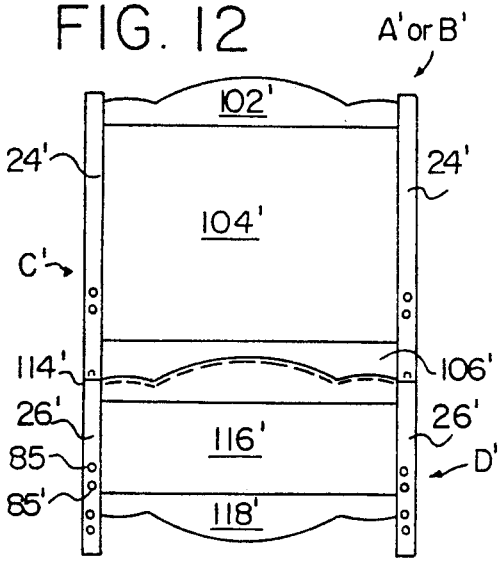
FIG. 13
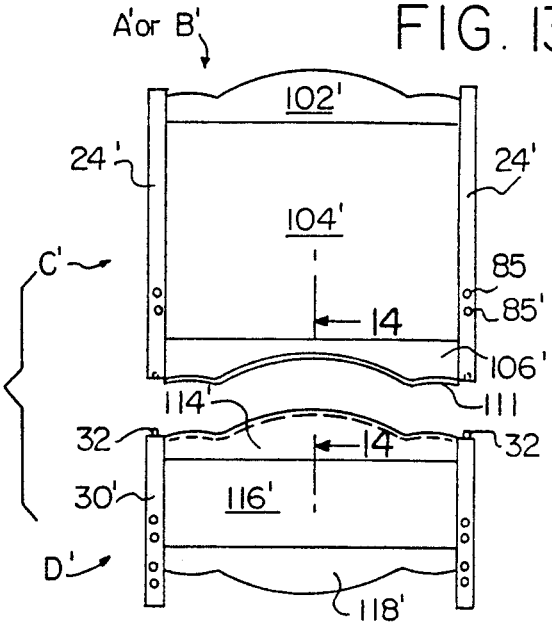
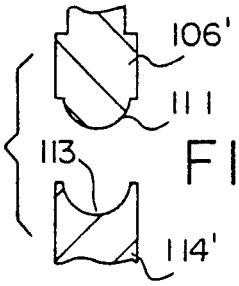
FIG. 14
FIG. 16
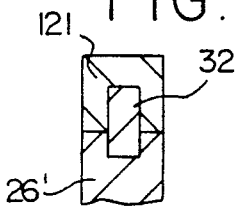
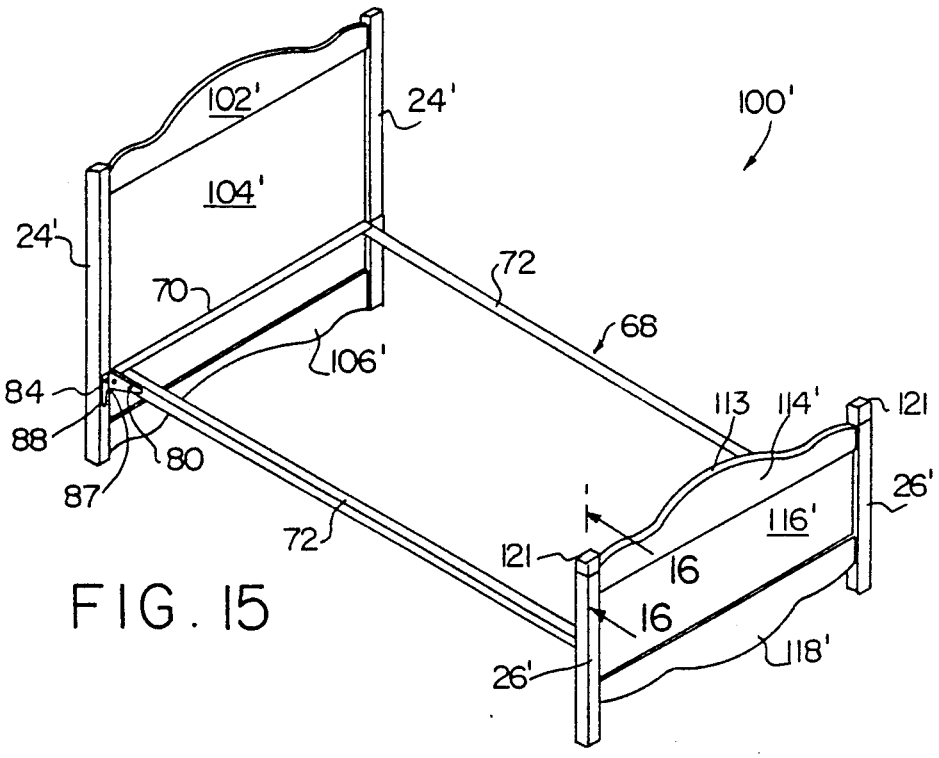
FIG. 15

CONVERTIBLE CRIB - YOUTH BED

BACKGROUND OF THE DISCLOSURE

1. Field of the Invention

This invention relates in general to children's beds and, more particularly, to an infant's crib adapted for convertibility into a youth's bed.

2. Description of the Prior Art

Heretofore infant cribs have been developed which are convertible into beds, and vice versa. For example, Boardman U.S. Pat. No. 1,378,518 shows a crib which can be used as a child's bed merely by removing its side frames and Yeager U.S. Pat. No. 1,388,783 discloses elements which can be combined to form a double bed, a twin bed or a crib. Another bed capable of being formed into three sizes is shown in Christensen U.S. Pat. No. 2,677,832 and has a headboard and footboard formed of frames which can be detached so that the largest bed has lower ends than do the bassinet and baby bed. Gottfried, et al. U.S. Pat. No. 3,403,412 also discloses removable panels at the ends of a crib and removable sides for forming a youth bed, adult bed or a couch. All of the above patents, however, provide only one position for a mattress, regardless of the type of bed (crib, youth or adult) in which the mattress is placed and regardless of the size of the person who will be using the bed.

Hull U.S. Pat. No. 4,361,919 similarly discloses a convertible crib lacking a height-adjustable mattress. The bed shown in Hull suffers from the additional drawbacks of having a conversion construction which requires additional parts and yields a youth bed twice as long as the crib, requiring a second mattress. A later patent issued to Hull, U.S. Pat. No. 4,450,597 provides two different mattress heights in a convertible crib, but again the youth bed resulting from conversion requires a longer mattress than does the crib. Lastly, Necowitz U.S. Pat. No. 4,525,883 shows conversion of a full size bed to a crib by means of a frame surrounding the mattress (much like a waterbed frame), the frame having apertures for insertion of posts so that a fence can be installed around the perimeter of the bed.

By contrast, Germano U.S. Pat. No. 3,727,346 discloses a device for adopting a set of crib springs for use with a separate headboard/footboard set, with or without integral legs, to form a regular bed. In the crib shown by Germano, the mattress can be vertically moved to different positions.

Known convertible cribs, such as those shown by Necowitz, Hull '919, Hull '597 and Boardman suffer from very heavy and/or bulky designs and some, such as Necowitz, are quite limited in their adaptability. Other convertible cribs have quite complicated adaption features. They require extraneous parts or larger mattresses and deny or at least restrict, crib mattress adjustment.

SUMMARY OF THE INVENTION

Accordingly, it is an object of the present invention to provide an infant's crib which is specially adapted for converting into a child's regular bed.

It is another object of the present invention to provide a crib having the feature stated which has a multiplicity of selectable mattress heights, which mattress can further be used in the youth bed form of the invention, being of the same length and width.

It is a further object of the invention to provide a crib having the features stated which is of lightweight, but sturdy construction, being quick and simple to convert using only some of the parts of the crib and no additional parts. The only tool necessary for conversion is a screwdriver.

It is a still further object of the present invention to provide a crib having the features stated which has a headboard and a footboard of easily divided panels which may be separated and stored or used thereafter for forming the headboard and footboard of the converted youth bed.

In furtherance of these objects, the present invention is, briefly, a rectangular infant's crib. The crib comprises a structural support frame, ends, legs, and means for attaching the ends to the legs. The legs are securely fixed in an up-right position to the crib frame at each corner of the crib. The crib ends comprise a plurality of interconnecting slats and panels, some of which are separable, adapted for permitting optional conversion of the crib to a youth's bed. Removable, lockable sides permit selective enclosing of the crib, and are slidably connected to the crib legs. Means for selective attachment within the perimeter of the crib are provided upon mattress support means. Mattress height adjustment means interconnect with the mattress support attachment means to permit lowering of the mattress support means, as required, to prevent the growing infant from independently exiting the crib.

BRIEF DESCRIPTION OF THE DRAWINGS

FIG. 1 is a perspective view of an infant's crib, constructed in accordance with, and embodying, the present invention.

FIG. 2 is an elevational view taken on line 2—2, FIG. 1.

FIG. 3 is a side elevational view of means for selective attachment, carried on the mattress support of the present invention, as connected in its uppermost position on the bracket of FIG. 2 taken on line 3—3.

FIG 4 is a plan view of the means for selective attachment of FIG. 3, taken on line 4—4, showing a crosssection of the crib headboard and attached leg.

FIG. 5*a* is an elevational view of the inside of a headboard as detached from the crib of FIG. 1.

FIG. 5*b* is an elevational view of the inside of a footboard as detached from the crib of FIG. 1.

FIG. 6 is a vertical-sectional view taken on line 6—6 of FIG. 5*a*.

FIG. 7 is a horizontal transverse sectional view taken on line 7—7 of FIG. 5*a*.

FIG. 8 is a vertical sectional view of a leg of the headboard of FIG. 5*a* taken on the line 8—8.

FIG. 12 is an elevational view of the inside of an alternative or footboard for the crib being constructed in accordance with and embodying the present invention.

FIG. 13 is an exploded elevational view of the inside of the alternative headboard or footboard shown in FIG. 12.

FIG. 14 is a vertical transverse sectional view taken on line 14—14 of FIG. 13.

FIG. 15 is a perspective of a youth's bed formed with the alternative headboard or footboard of FIG. 12.

FIG. 16 a vertical transverse sectional view taken on line 16—16 of FIG. 15.

DESCRIPTION OF PRACTICAL EMBODIMENTS

Figure 9:
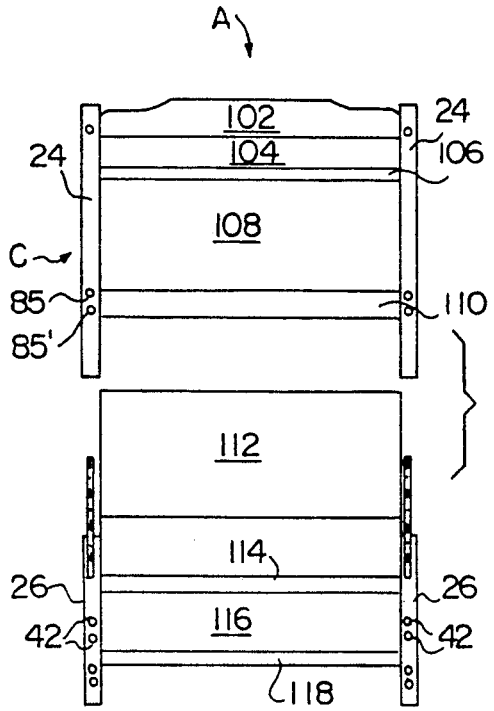
FIG. 9 is an exploded elevational view of the headboard of FIG. 5*a*.

Referring now to the drawings, the convertible crib of the present invention is illustrated in FIG. 1, being generally designated 20 and comprising endboards including a headboard A and a footboard B, (FIGS. 5*a* and 5*b*, respectively). The endboards are most commonly made from wood, but might conceivably be made of heavy plastic sheeting, fiberboard or even fiberglass panels. Headboard A (FIG. 5*a*) at each side thereof is provided with upper legs 24 and lower legs 26. Likewise, footboard B at each side thereof is provided with upper legs 28 and lower legs 30. The method of attachment is explained hereafter. A dowel 32 is journaled within a centered circular longitudinal bore (not shown) within both the lower end of each upper leg 24, 28 and the upper end of each lower leg 26, 30 to such an extent that the upper and lower leg end portions are firmly connected in longitudinally aligned relationship. Each upper leg 24, 28 is also removably fixed to the respective lower leg 26, 30 by preferably metal brackets 34 (explained hereafter), which additionally serve as means to adjust the height of a mattress (not shown). The lower legs 26, 30 each have casters 36 inserted at their base ends for facilitating mobility of crib 20.

Each headboard lower leg 26 is connected to footboard lower leg 30 on the same side by a bar 38 which constitutes a crib frame generally designated F and to which lower legs 26, 30 are securely fixed in an upright position. Crib frame F bars 38 are provided at each end with a horizontal flange 40, which is attached by conventional screws 41 inserted into screw holes 42 of flange 40, to lower legs 26, 30. Bars 38 are formed of metal, but may also be of wood, or other strong, rigid materials.

Each crib upper leg 24, 28 is attached at the upper end thereof to a, preferably, metal rod 44. Carried on rod 44 at the upper end thereof is a hooked portion 46 terminating in a flattened flange 48 wherein a hole is formed for attachment by conventional screws (not shown) at the top of the inner surface of upper legs 24, 28, as shown in FIG. 1. Rod 44 (FIG. 1) is positioned vertically so as to pass downwardly through an alignment or guide hole 50 (shown in FIG. 7) in a flange 52 of mattress adjustment bracket 34. An L-bracket 54 (shown in FIG. 1) is screw attached at the inner bottom of lower leg 26, 30 and serves as a seat for rod 44, as well as for a coil spring 56, through which rod 44 passes before stopping against L-bracket 54. Rod 44 provides sliding attachment of the crib's sides, generally designated S, to each end of headboard A and footboard B.

Each crib side S consists of closely spaced vertical posts 58 carried between a horizontal upper rail 60 and horizontal lower rail 62. Side rails 60, 62 are formed with vertical apertures formed at each end for passage therethrough of rail rod 44. Each lower rail 62 is provided with at least one center mounted depending flanges (not shown) for locking interconnection with a notched flange 64 attached to a spring-loaded kick bar 66 suspended from each crib frame bar 38 to maintain crib side S in its raised position, as shown in FIG. 1. Slight upward pressure on upper rail 60 immediately followed by foot pressure on kick bar 66 disengages flanges 64 and releases the associated side S for lowering, until such side S rests at each end upon related coil spring 56, for ease of access to the interior of crib 20.

A mattress support structure M is positioned inward of crib sides S, headboard A and footboard B. Structure M comprises a rigid frame 68, ordinarily of metal, but may be of wood or very strong plastic, comprising end bars 70 and sidebars 72, to which are attached web-like springs 74. Springs 74 are usually metal, but may be replaced, for example, by a plastic web or nylon mesh. End bars 70 are secured to side bars 72 by metal brads 76 and a diagonal corner brace 77, as shown in FIG. 4. A bracket 34 is vertically attached to the inner surface of crib legs 24, 26, 28 and 30 by conventional screws 94 which penetrate bracket 34 holes 92 in such manner as to connect corresponding upper 24, 28 and lower 26, 30 legs. A bracket 80 is attached by metal brads 82 to each outer end surface of side bars 72 and is provided with an outwardly extending horizontal right angle flange 84 (FIG. 2) upon which an upwardly located screw hole 86 is provided. A depending extension 88 is located at the lower outermost corner of flange 84.

FIG. 2 illustrates that each mattress adjustment-support bracket 34 is provided, spaced along the length thereof, with a plurality of alternating hooks 90 and screw holes 92. Brackets 34 are thus secured at equal height at each corner of crib 20 so that mattress support structure M will be level when selectively positioned along bracket 34. To that end, outward flange 84 of each corner of spring frame 68 is seated within hook 90 at the same level at each corner. Depending extension 88 acts as a stop to prevent frame 68 from being inadvertently shifted inwardly and off supporting hook 90.

Mattress support frame 68 can thus be repositioned by merely lifting one end to free flange 84 from hook 90 and shifting it to a similar hook 90 but at a different level. This operation can easily be performed with the mattress (not shown) in place. Ordinarily, for convenience, the mattress support is positioned near the top of bracket 34 when the infant is newborn and shifted to successively lower positions as the child grows. This process provides a progressively higher wall, formed by the crib sides S, to prevent the maturing young child from leaving crib 20 unassisted.

Figure 11:
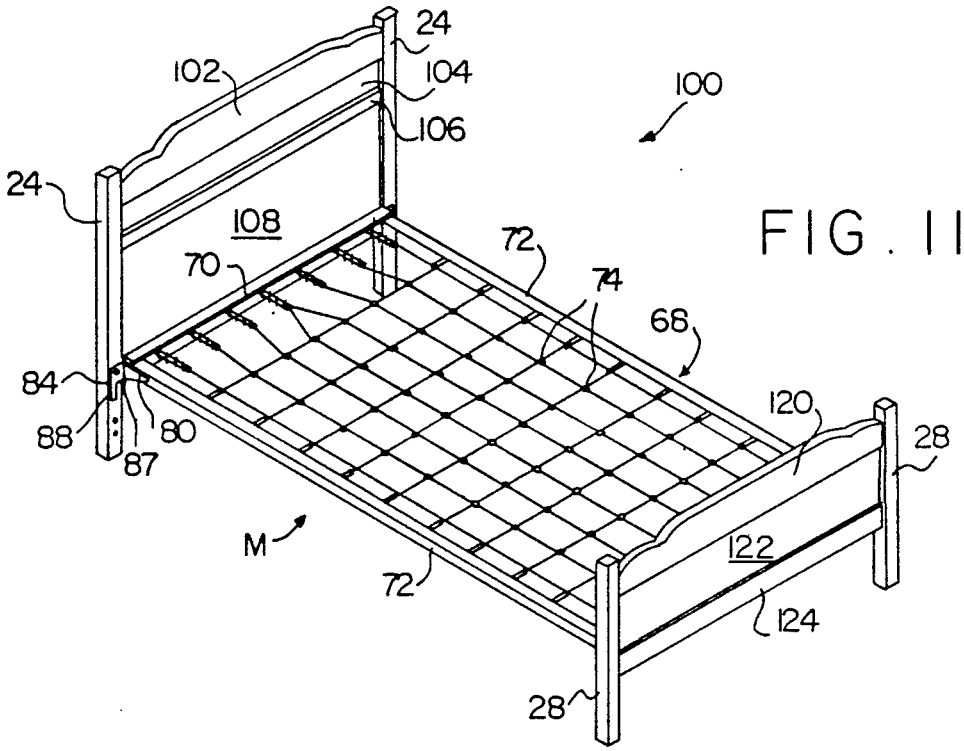
FIG. 11 is a perspective view of a youth bed formed from parts of the crib of FIG. 1.

When the child is old enough to sleep without crib sides S, crib 20 can be converted into a youth bed, generally designated 100 and shown in FIG. 11, as hereafter described. FIG. 5*a* illustrates that the preferred crib headboard A comprises, in descending order, crown slat 102, top panel 104, upper slat 106, upper middle panel 108, middle slat 110, lower middle panel 112, lower slat 114, bottom panel 116 and base slat 118. FIG. 9 illustrates that crib headboard A and footboard B may be disassembled to provide upper sections, or units, C, D respectively, which may be used as headboard C and footboard D for youth bed 100. Parts 102, 104, 106, 108, 110 of headboard C are successively fixedly attached to upper legs 24. Each panel section, for example 108 as illustrated in FIG. 4, attaches to a leg portion, for example 24, in a tongue and groove fashion; the vertical edge 109 of panel 108, being the tongue that fits into a vertical groove 31 formed in each inner leg surface. Likewise, a groove (not shown) formed lengthwise along the center of the lower edge of slat 110 accepts the bottom edge of panel 108. The other adjacent slats and panels, previously discussed, fit together in similar fashion. For illustration, phantom lines in FIG. 5*a* depict the top and bottom edges of lower middle panel 112 within slats 110 and 114, respectively. As an alternative to the form illustrated, top panel 104 may be replaced by closely spaced wooden spindles or other decorative objects.

Headboard A components 114, 116 and 118 are fixedly attached to lower legs 26 in a manner similar to that described above. Panel 112, however, is slidably separable from adjacent parts 24, 26, 110, 114. Thus youth headboard C can be lifted as unit from crib headboard A after removing rod 44 rails 60, 62 mattress support structure M and screws 94 from crib 20.

In similar fashion, crib footboard B (FIG. 5*b*) is comprised, in descending order, of crown slat 120, top panel 122, upper slat 124, middle panel 126, lower slat 128, lower panel 130 and base slat 132. Parts 120, 122 and 124 are fixedly attached to adjacent parts thereto and to upper leg 28 and are similarly removable from crib footboard B to form youth bed footboard D (FIG. 11). Middle panel 126 is slidably separable from adjacent parts 28, 34, 124, 128 in a manner previously described in regard to panel 112. Phantom lines in FIG. 5*b* depict the top and bottom edges of middle panel 126 received within adjacent grooves in slats 124, 128. Lower panel 130 remains attached to adjacent slats 128, 132 and lower leg portions 30.

Figure 10:
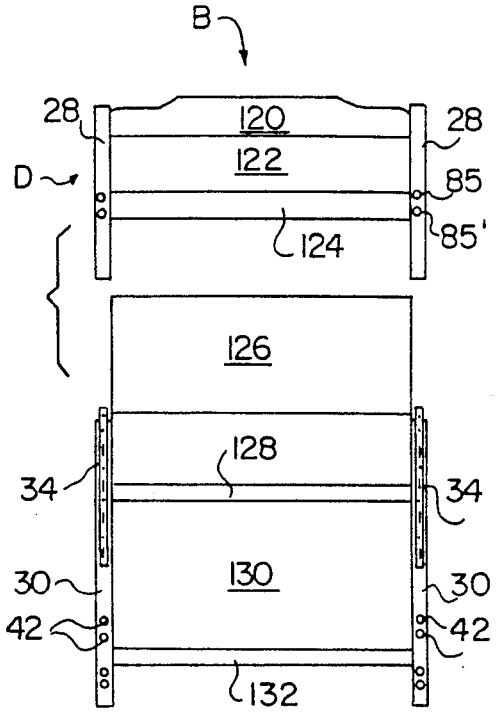
FIG. 10 is an exploded elevational view of the footboard of FIG. 5*b*.

In order to convert crib 20 into youth bed 100, the folowing procedure is followed: First, the single screw (not shown) attaching each rail rod 44 by integral flange 48 to an upper crib leg portion 24, 28 is removed. Each rod 44 is lifted from L-bracket 54 and sides S are subsequently lifted away from crib 20 so that all of the aforementioned parts may be placed in storage. The crib mattress and associated support structure M are lifted from disposition thereof on brackets 34 and set aside for use in youth bed 100. A screw 94 securing bracket 34 is removed from each upper crib leg 24, 26. At this point the youth bed headboard unit C and footboard unit D can be easily lifted away from the lower portions crib headboard A and footboard B, respectively (FIGS. 9 and 10). Mattress support structure M may now be reused (See FIG. 11) in youth bed 100 by inserting a screw (not shown) through hole 86 in each outward flange 84 (FIG. 2) into apertures 85 in the inner lower surface of each leg 24, 28 (FIGS. 9, 10). Simultaneously, the lower edge 87 of flange 84 will rest atop another conventional screw (not shown) extending from a second aperture 85', directly beneath aperture 85 and inwardly of depending extension 88 on flange 84. Thus, for safety and stability, the mattress is supported by structure M, which is connected at two points on each of the four bed legs 24, 28. Conveniently and economically, the same mattress may be used on both crib 20 and youth bed 100 because they are of the same dimensions. Remaining lower portions of headboard A, B and bars 38 of crib 20 may be placed in storage. Bed 100 rests directly upon the floor surface, as shown in FIG. 11, or alternatively, for increased height and mobility, bed 100 may be supported on conventional casters, such as those at 36, FIG. 1, inserted within the bore remaining in the base of legs 24, 28 when they are removed from associated dowel 32 (shown in FIGS. 7, 8).

Alternative embodiments may be substituted for the above described practical form of the invention. One such alternative is illustrated in FIGS. 12, 13, 14, 15 and 16. For simplicity, only those features which vary from the embodiment of FIG. 1 will be discussed. FIGS. 12 and 13 illustrate an alternative crib endboard which may serve as a headboard A' or an identical footboard B', each having fewer panels and slats than in the above described embodiment of FIG. 1. Endboard A'/B' comprises crown slat 102', top panel 104' and upper slat 106' consecutively connected to each other and upper legs 24', as described in the first embodiment, to form youth bed headboard C'.

In like fashion, identical youth bed footboards D' are formed from crib headboard A' and footboard B'; specifically, lower slat 114', bottom panel 116', base slat 118' and lower legs 26'. Each resulting set of headboards C' and footboards D' can be used to form a twin youth bed 100' as illustrated in FIG. 15 (springs not shown). Other than those parts taken from the crib (not shown, formed with endboards A', B'), a second mattress structure M and mattress (not shown, formed with endboard (stress) structure M and mattress (not shown) will be needed. Alternatively, crib frame bars 38 may be used in place of a second mattress support structure if a box spring and mattress are used for the second youth bed. Another feature of the alternative endboard A'/B' is illustrated in FIG. 14. Rather than the snugly fitting tongue and groove type slat and panel connection previously discussed, the lower edge of upper slat 106' carries along its length a convex extension 111 which seats into a corresponding concave groove 113 along the top edge length of lower slat 114' (illustrated by a phantom line in FIG. 12). This arrangement provides a stabilizing influence between connected upper and lower crib units C', D' and also provides youth bed footboard D' with a decorative upper edge appearance.

FIG. 13 provides an exploded view of alternative crib endboard A' or B'(A' and B' are identical) and exposes dowel 32 which extends between and firmly connects upper and lower crib leg 24', 26', in like fashion as the embodiment of FIG. 8. In order that dowel not be exposed to view or possible harm when section D' serves as the youth bed footboard (FIG. 15), a cap 121 is provided to fit tightly over the dowel and appear as an upward extension of leg portion 26'. This arrangement is illustrated in FIG. 16.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A rectangular infant's crib optionally converting into a youth bed comprising crib frame means for providing structural support to said crib, crib end means, crib legs having vertical surfaces, means for attaching said end means to said legs, said legs being securely fixed in an upright position to said frame means at each corner of said crib; said crib end means each comprising a plurality of interconnecting slats and panels separable from one another for permitting optional conversion of said crib to a youth bed having the same length as said crib, removable, lockable crib side means for permitting selective enclosing of said crib, means for connecting said side means to said leg means, mattress support means adapted for selective attachment within the parameter of said crib, mattress height adjustment means for interconnecting with said selective attachment means and permitting progressive lowering of said mattress support means as required to prevent the growing infant from independently exiting the crib; said crib end means comprising a headboard and a footboard positioned at opposite ends of said crib and being provided with vertical outer side edges for attachment thereto of said crib leg means; each of said crib leg means comprising an upper leg and a lower leg and a connecting element; said upper leg having a lower end having an upwardly extending bore and said lower leg having an upper end having a similar bore extending downwardly; said bores for journaling said connecting element for firmly connecting longitudinally to each other said lower leg upper end and said upper leg lower end; said headboard and footboard being identical and comprised of four horizontal slats and two rigid, solid panels; each of said panels having four edges and being fixed along its top and bottom edges to a horizontal slat; each upper panel being fixed along each of its side edges to an upper crib leg and each lower panel being fixed along each of its side edges to a lower crib leg; each said upper panel and the slats and legs attached thereto forming a unit and each said lower panel and the slats and legs attached thereto forming a unit; said upper units being separable from said lower units for serving as headboards and footboards for forming twin youth beds.

2. An infant's crib as defined in claim 1 wherein said means for attaching said crib end means to said crib leg means comprises a longitudinal groove formed centrally and extending along an inside vertical surface of each leg means for slidably receiving and retaining the vertical outer side edges of said crib end means.

3. An infant's crib as defined in claim 1, wherein said lockable crib side means comprise horizontal upper and lower rails extending substantially the length of said crib and closely spaced vertical posts carried by and extending between said horizontal rails; said horizontal rails having opposing ends each defining a vertical opening throughout the entire depth thereof for passage therethrough of said means for connecting said crib sides to said crib legs.

4. An infant's crib as defined in claim 1, the lower slat of said upper unit having a lower edge and carrying a convex extension along the lower edge length thereof and the upper slat of said lower unit having a top edge length and carrying a corresponding concave groove along the top edge length thereof for providing a stabilizing seat for said upper unit convex extension when said upper units and associated lower units are detached to form said crib end means and for providing a decorative appearance to said upper unit and said lower unit when the upper and lower units are detached to form a youth bed headboard and footboard.

5. An infant's crib as defined in claim 1; said connecting element comprising a dowel having a diameter and an upper end for penetrating said upper leg lower end; said dowel upper end being exposed and extending vertically from said lower leg upper end when said upper unit is detached from said lower end unit; said crib further comprising independent cap means having a solid upper surface and a lower surface carrying a bore; said cap bore having a diameter sufficiently greater than the diameter of said connecting element to permit fitting tightly over said exposed dowel for protection thereof and for providing a decorative appearance when said lower end means unit is used as a youth bed footboard.

* * * * *